US008807711B2

(12) United States Patent
Shklyarevskiy et al.

(10) Patent No.: US 8,807,711 B2
(45) Date of Patent: Aug. 19, 2014

(54) INK JET PRINT HEAD WITH PIEZOELECTRIC ACTUATOR

(71) Applicant: OCE-Technologies B.V., Venlo (NL)

(72) Inventors: Igor O. Shklyarevskiy, Nijmegen (NL); Alex N. Westland, Baarlo (NL)

(73) Assignee: OCE-Technologies B.V., Venlo (NL)

( * ) Notice: Subject to any disclaimer, the term of this patent is extended or adjusted under 35 U.S.C. 154(b) by 0 days.

(21) Appl. No.: 13/839,762

(22) Filed: Mar. 15, 2013

(65) Prior Publication Data

US 2013/0201259 A1 Aug. 8, 2013

Related U.S. Application Data

(63) Continuation of application No. PCT/EP2011/070536, filed on Nov. 21, 2011.

(30) Foreign Application Priority Data

Nov. 30, 2010 (EP) ..... 10193127

(51) Int. Cl.
*B41J 2/045* (2006.01)
*B41J 2/14* (2006.01)

(52) U.S. Cl.
CPC ..... *B41J 2/14201* (2013.01); *B41J 2/14233* (2013.01); *B41J 2002/14241* (2013.01)
USPC ..... 347/70; 347/68; 347/71

(58) Field of Classification Search
CPC ..... B41J 2/14233; B41J 2/161; B41J 2002/14491; B41J 2/1646; B41J 2002/14419; B41J 2/1642; B41J 2002/14241; B41J 2/1629; B41J 2/1631; B41J 2/1628; B41J 2/1626; B41J 2/14201; B41J 2202/11; B41J 2/1607; B41J 2/1643; B41J 2202/03; B41J 2/164; B41J 2002/14266; B41J 2/14032; B41J 2/14274; B41J 2/1612; B41J 2/1632; B41J 2/1637; B41J 2/1645; B41J 2002/14258; B41J 2/045; B41J 2/14298
See application file for complete search history.

(56) References Cited

U.S. PATENT DOCUMENTS

| | | | | |
|---|---|---|---|---|
| 7,101,026 | B2 | 9/2006 | Shimada et al. | |
| 2005/0134654 | A1* | 6/2005 | Yasoshima | 347/70 |
| 2006/0158486 | A1 | 7/2006 | Bibl et al. | |
| 2010/0097431 | A1* | 4/2010 | Takakuwa | 347/68 |
| 2011/0115341 | A1* | 5/2011 | Birkmeyer et al. | 310/364 |

FOREIGN PATENT DOCUMENTS

| | | | |
|---|---|---|---|
| EP | 0884184 | A1 | 12/1998 |
| WO | WO 2006/009941 | A2 | 1/2006 |
| WO | WO 2009/142960 | A1 | 11/2009 |
| WO | WO 2009/143354 | A2 | 11/2009 |

* cited by examiner

*Primary Examiner* — Justin Seo
(74) *Attorney, Agent, or Firm* — Birch, Stewart, Kolasch & Birch, LLP

(57) ABSTRACT

An ink jet print head, having a pressure generation chamber arranged for being in communication with a print head nozzle and an actuator membrane for delimiting the pressure generation chamber. The actuator membrane has a substrate and a piezoelectric actuator provided on the substrate, said piezoelectric actuator having a lower electrode, an upper electrode and at least one piezoelectric layer arranged between the lower electrode and the upper electrode; the substrate and the upper electrode are arranged on opposite sides of the piezoelectric layer, and the upper electrode has a Titanium-Tungsten film.

12 Claims, 3 Drawing Sheets

INK JET PRINT HEAD WITH PIEZOELECTRIC ACTUATOR

CROSS REFERENCE TO RELATED APPLICATIONS

This application is the Continuation of PCT/EP2011/070536 filed on Nov. 21, 2011, which claims priority under 35 U.S.C. 119(a) to European Patent Application No. 10193127.7 filed on Nov. 30, 2010, all of which are hereby expressly incorporated by reference into the present application.

BACKGROUND OF THE INVENTION

1. Field of the Invention

The invention relates to an ink jet print head, in particular an ink jet print head comprising a piezoelectric actuator. In particular, the invention relates to an ink jet print head, in which a piezoelectric actuator is arranged to be used in a deflection mode for deflecting an actuator membrane in order to pressurize ink in a pressure generation chamber.

2. Description of Background Art

U.S. Pat. No. 7,101,026 B2 describes different types of ink jet recording heads. A piezoelectric element is placed on one side of a flow passage formation substrate via a diaphragm and has a lower electrode, a piezoelectric layer and an upper electrode. At least one of the layers deposited under or on top of the piezoelectric layer is a compression film having a compressive stress, and the compression film has at least a part in a thickness direction removed in at least a part of an area opposed to a pressure generation chamber, whereby the stress of the whole film is decreased. In one example, the diaphragm is made up of an elastic film and a lower electrode film, on top of which a piezoelectric film and an upper electrode film are patterned. The material of the upper electrode film has a compressive stress in an opposite direction to a stress of the piezoelectric film.

US 2006/0158486 A1 describes a printhead module having a piezoelectric actuator positioned over a pumping chamber and configured to deflect and pressurize the pumping chamber. A ground electrode layer is deposited on a nozzle plate. A piezoelectric layer is metallised on one surface with a layer of Titanium-Tungsten, and the metal layer is bonded and electrically connected to the metallic ground electrode layer. A silicon handle layer is removed on the other side of the piezoelectric layer. A metal layer forming a drive electrode is disposed on the exposed surface of the piezoelectric layer by sputtering layers of metal, e.g. Titanium-Tungsten and/or gold.

WO 2009/143354 A2 describes an ink jet printhead having a multi-layered actuator bonded onto a membrane, such as a layer of silicon. The actuator includes a lower conductive layer, a piezoelectric layer and an upper conductive layer. The upper conductive layer provides an upper electrode. The piezoelectric layer, which is metallised with a metal that forms the lower conductive layer, is bonded onto the membrane. Alternatively, the piezoelectric layer is formed directly on the lower conductive layer. In one example, the upper conductive layer includes a Titanium-Tungsten alloy layer and a gold layer.

WO 2006/009941 A2 deals with an ink jet print head module having a piezoelectric element stiffened by a curved surface. The stiffened piezoelectric element is prepared by grinding a curved surface into a thin layer of piezo-electric material or by injection molding a precursor into a mold having the curved surface features of the piezoelectric element.

SUMMARY OF THE INVENTION

Lead zirconate titanate (PZT) is a ceramic compound of lead, oxygen and Titanium and/or zirconium, which is commonly used for manufacturing piezoelectric actuators due to its piezoelectric effect.

When thin PZT films are deposited on a substrate, the final processing step for the PZT material is usually annealing at a high temperature of e.g. approximately 600° C. to 700° C. Because of the high temperature, the PZT film shrinks considerably. This results in tensile stress in the PZT film. An inherent deflection of an actuator membrane comprising such a PZT film limits the usable amount of deflection when the piezoelectric actuator is energized.

It is an object of the invention to provide an ink jet print head having a piezoelectric actuator provided on a substrate having an improved pressure generation ability.

In order to facilitate achieving this object, according to the invention, there is provided an ink jet print head according to claim 1.

Titanium-Tungsten is an alloy of Titanium and Tungsten. An upper electrode comprising a Titanium-Tungsten film has been found to provide a considerably strong compressive stress in lateral direction of the film, which allows to counteract or balance a net tensile stress of the lower layers of the substrate and the piezoelectric actuator and thereby reduce or cancel an inherent deflection of the substrate and actuator.

The actuator membrane comprises a multilayer package, which comprises said substrate and said lower electrode, said piezoelectric layer, and said upper electrode of said piezoelectric actuator. For example, said lower electrode, said piezoelectric layer, and said upper electrode are deposited on the substrate, i.e. they are build up in situ on the substrate, e.g. using one or more methods of sputtering, chemical solution deposition and the like as known in the art.

For example, the multilayer package comprising the substrate and the layers of the piezoelectric actuator may be flat in a non-actuated state. Titanium-Tungsten is of considerable advantage due to its high conductivity and because a comparatively thin film of Titanium-Tungsten can provide the desired stress compensation effect. Therefore, the thickness and mass of the piezoelectric actuator can be reduced, contributing to a high deflection efficiency. Thus, energy consumption of the piezoelectric actuator can be reduced.

As a further advantage, an upper electrode comprising a Titanium-Tungsten film has been found to enhance the stability, reliability and/or durability of the piezoelectric actuator. Thus, a high printing quality may be maintained for a longer time. In particular, the multilayer package will be flat if, when the actuator is in a non-actuated state, the layer thicknesses of the multilayer package fulfill the mathematical relation of $$\Sigma\sigma_i t_i(z_i - z_0) = 0,$$

the sum being taken for all layers i=1, . . . , n, and in which $\sigma_i$=stress in layer i, $t_i$=thickness of layer i, and $(z_i - z_0)$=distance between the center of layer i and the neutral surface of the multilayer package; wherein the neutral surface is the surface in which the bending tension is zero when the package is being bent.

The term "lower electrode" is used to designate an electrode that is closer to the substrate than said at least one piezoelectric layer. The substrate and the upper electrode are positioned on opposite sides of the piezoelectric layer.

The piezoelectric actuator is arranged for deflecting the substrate when energized. For example, the piezoelectric actuator is arranged for deflecting the actuator membrane by deflecting the piezoelectric layer when energized. For example, the Titanium-Tungsten film is deflected with the piezoelectric layer, e.g. as a part of the multilayer package being deflected, i.e. bent. For example, a topmost layer arranged to be deflected with the piezoelectric layer is a conductive layer of the upper electrode. That is, there is no further layer on top of said conductive layer. In particular, there is no insulating or non-conducting layer on top of the conductive layer. Preferably, the Titanium-Tungsten film is said topmost layer to be deflected with the piezoelectric layer.

Preferably, the upper electrode is made of Titanium-Tungsten. For example, the upper electrode consists of the Titanium-Tungsten film.

Further embodiments of the invention are indicated in the dependent claims.

For example, the Titanium-Tungsten film comprises a compressive stress, i.e. a compressive stress in a lateral direction of the film. For example, the Titanium-Tungsten film increases a flatness of the substrate and the piezoelectric actuator due to compressive stress of the Titanium-Tungsten film. Preferably, the substrate and the layers of the actuator are flat in a non-energized state of the piezoelectric actuator. For example, the thickness of the Titanium-Tungsten film is such that the substrate is flat in a non-energized state.

The term "flat" is to be understood as meaning having a radius of curvature of at least 30 mm. Regarding the typical dimensions of pressure generation chambers of ink jet print heads, such curvature can be regarded as being flat.

For example, the Titanium-Tungsten film is arranged to at least partially compensate a tensile stress of the piezoelectric layer.

For example, the Titanium-Tungsten film is arranged to counter act an intrinsic deflection of a multilayer package comprising the substrate and the layers of the actuator, said layers comprising the lower electrode, the upper electrode and the at least one piezoelectric layer. For example, the Titanium-Tungsten film is arranged to counter act in intrinsic deflection of the actuator membrane.

For example, the Titanium-Tungsten film is arranged to flatten said multilayer package and/or said substrate and/or said actuator membrane.

If not explicitly expressed otherwise, the term "stress" refers to compressive or tensile stress in a lateral direction of a film, layer, substrate, etc.

For example, the upper electrode has a thickness that is less than a tenth (i.e. 1/10) of a thickness of the at least one piezoelectric layer.

For example, the upper electrode has a thickness less than 500 nanometer, preferably less than 400 nanometer, more preferably less than 300 nanometer.

In an embodiment of the inkjet print head, the piezoelectric actuator is covered with a moisture barrier layer, the moisture barrier layer for example comprising $Al_2O_3$ or comprising a layered structure of $SiO_2/Si_3N_4/SiO_2$. Such moisture barrier layer prevents that moisture may penetrate the piëzo-actuator.

In a further aspect of the invention, there is provided a printing apparatus, comprising at least one ink jet print head as described. The printing apparatus is, for example, a printer, a copier, etc.

It is noted that it is known in the art, as e.g. disclosed in WO2009/142960, to pattern a PZT actuator layer by application of a NiCr masking layer on a bonding layer made of TiW. In view of the present invention, it is contemplated that a process for manufacturing a print head may include the steps of (a) providing a TiW layer on a PZT layer, the TiW layer having a thickness in accordance with the present invention, (b) providing a NiCr layer on the TiW layer, (c) patterning the NiCr layer and the TiW layer to form an etch mask, (d) etching the PZT layer in accordance with the mask formed by the NiCr and TiW layer and (e) removing the NiCr layer, thereby leaving the TiW layer as a top electrode and thus eliminating any subsequent steps for providing a top electrode on the patterned PZT layer. Of course, such method may as well be performed using other suitable materials instead of PZT or NiCr. The inventive concept is to have a top electrode layer that is also used as a bonding layer during processing.

BRIEF DESCRIPTION OF THE DRAWINGS

The present invention will become more fully understood from the detailed description given herein below and accompanying drawings which are given by way of illustration only and are not limitative of the invention, and wherein.

DETAILED DESCRIPTION OF THE PREFERRED EMBODIMENTS

Figure 1:
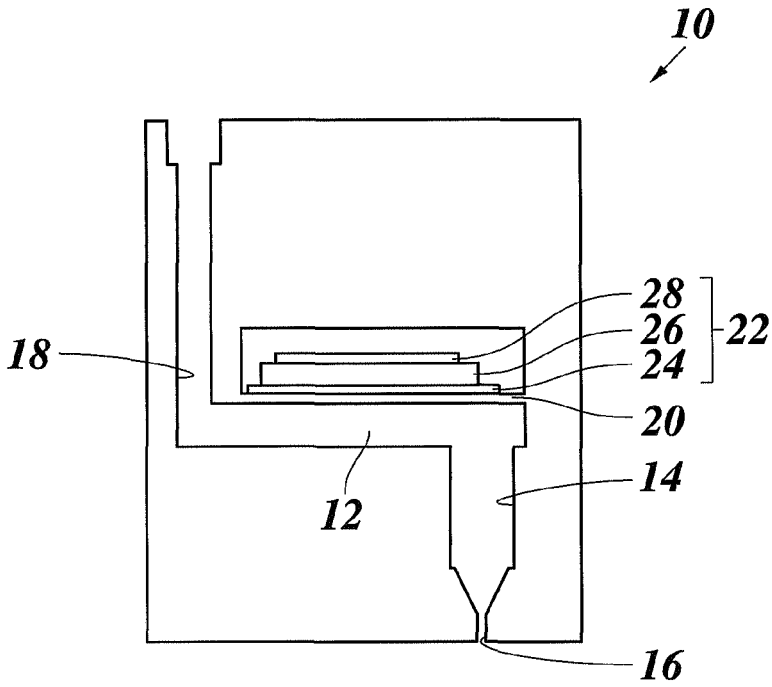
FIG. 1 is a schematic cross-sectional partial view of an ink jet print head according to the invention.

In FIG. 1, a part of an ink jet print head 10 is shown having a pressure generation chamber 12 which is connected via a feed through 14 to a print head nozzle 16. Ink is supplied to the pressure generation chamber 12 through an inlet 18, which is e.g. connected to a common ink supply channel of several pressure generation chambers 12. The pressure generation chamber 12 is, in a use state, filled with ink, for example hot melt ink in its liquid state.

The pressure generation chamber is of general cuboid shape. A substantial part of a top wall of the pressure generating chamber 12 is formed by a substrate 20. Thus, the substrate 20 delimits the pressure generation chamber. Several pressure generating chambers 12 of the print head 10 may have respective substrates 20 formed by a common substrate.

Whereas a first side of the substrate 20 defines an interior wall of the pressure generation chamber 12, a piezoelectric actuator 22 is provided on a second side of the substrate 20. The substrate 20 and the piezoelectric actuator 22 form an actuator membrane delimiting the pressure generation chamber. The actuator membrane is a multilayer package or multilayer stack consisting of the substrate 20, a lower electrode 24, a piezoelectric layer 26, and an upper electrode 28. The piezoelectric layer 26 is a piezoelectric ceramic layer of lead zirconate titanate. The piezoelectric actuator 22 comprises the lower electrode 24, the piezoelectric layer 26 and the upper electrode 28.

Details of the multilayer package will be described with regard to specific embodiments of FIG. 2 and FIG. 3.

Figure 2:
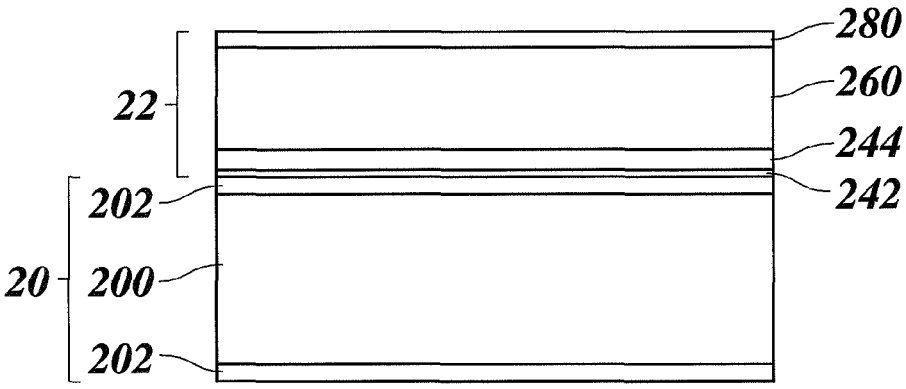
FIG. 2 is a schematic view of a multilayer package according to a first embodiment.

In the example of FIG. 2, the substrate 20 is a silicon based substrate that is formed by a silicon layer 200, in particular a monocrystalline silicon substrate, on which surface oxide layers 202, i.e. silicon oxide films, have been formed. A thickness of the oxide layer 202 is considerably smaller than that of the silicon layer 200.

On the upper surface oxide layer 202, first, an adhesion layer 242 of the lower electrode 24 is deposited. The adhesion layer 242 is a Titanium layer and is deposited by sputtering. On top of the adhesion layer 242, a platinum layer 244, forming the main conductive layer of the lower electrode 24, is formed.

Next, the piezoelectric layer 26 is formed of lead zirconate titanate (PZT), e.g. by chemical solution deposition. After annealing at high temperature of e.g. 600° C. to 700° C., a PZT layer 260 results having a tensile stress, whereas the substrate 20 comprises a compressive stress.

On top of the PZT layer 260, the upper electrode 28 in the form of the Titanium-Tungsten film (TiW layer) 280 is formed by sputtering and annealing. The TiW layer 280 is under compressive stress. The TiW layer 280 has a composition of, for example, 10 wt % Titanium (Ti) (i.e. 10% by weight) and 90 wt % of Tungsten (W). In the deposited TiW layer 280 a compressive stress builds up.

The thickness of the TiW layer 280 is chosen such that the resulting multilayer package is substantially flat. That is, an intrinsic deflection of the structure comprising the substrate 20, the lower electrode 24 and the PZT layer 260, is cancelled by the TiW layer 280. In particular, the Titanium-Tungsten film 280 compensates the tensile stress of the piezoelectric layer 26.

In general, the multilayer package will be flat, when the actuator is in a non actuated state, when the layer thicknesses of the multilayer package fulfill the mathematical relation of $$\Sigma\sigma_i t_i(z_i - z_0) = 0,$$

the sum being taken for all layers i=1, . . . , n, and in which $\sigma_i$=stress in layer i, $t_i$=thickness of layer i, and $(z_i - z_0)$=distance between the center of layer i and the neutral surface of the multilayer package; wherein the neutral surface is the surface in which the bending tension is zero when the package is being bent.

Table 1 shows three examples of layer thicknesses of the first embodiment which satisfy the above formula.

TABLE 1

| Layer | Layer Thickness (nm) Example 1 | Layer Thickness (nm) Example 2 | Layer Thickness (nm) Example 3 |
|---|---|---|---|
| TiW | 230 | 150 | 110 |
| PZT | 3000 | 2000 | 2000 |
| Pt | 300 | 200 | 100 |
| Ti | 30 | 30 | 30 |
| $SiO_2$ | 500 | 500 | 500 |
| Si | 5000 | 5000 | 5000 |
| $SiO_2$ | 500 | 500 | 500 |

In the examples, the silicon layer 200 of the silicon substrate 20 has a thickness of 5000 nanometer, and the surface oxide layers 202 have a thickness of 500 nanometer each.

With a Pt layer 244 of 300 nanometer and a PZT layer 260 of 3000 nanometer, a TiW layer 280 having a thickness of 230 nanometer is expected to have a compressive stress that leads to a flatness of the multilayer package and, thus, the substrate 20.

With a PZT layer of 2000 nanometer, a TiW layer of 150 nanometer is sufficient for a lower electrode having a Pt layer of 200 nanometer, and a TiW layer of 110 nanometer is sufficient for a lower electrode Pt layer of 100 nanometer. Thus, the upper electrode TiW layer 280 has a thickness less than a tenth of a thickness of the PZT layer 260 in each case.

Figure 3:
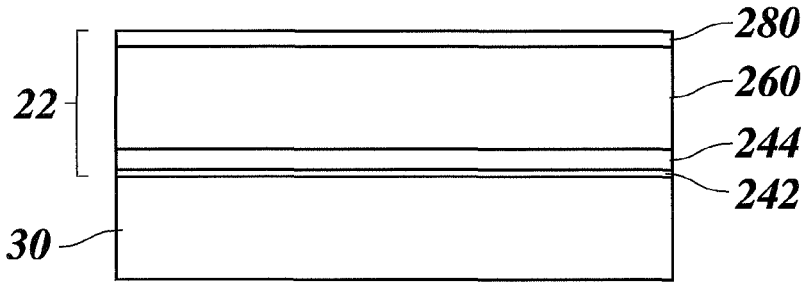
FIG. 3 is a schematic view of a multilayer package according to a second embodiment.

FIG. 3 shows an actuator membrane in the form of a multilayer package of a second embodiment having a silicon nitride ($Si_3N_4$) substrate 30. The substrate 30 and the piezoelectric actuator 22 form a multilayer package consisting of the $Si_3N_4$ layer of the substrate 30, an adhesion layer 242 of Titanium, a platinum layer 244, a PZT layer 280 and a TiW layer 280.

The layers may be prepared similar to the embodiment of FIG. 2. The piezoelectric actuator comprises the Ti adhesion layer 242 and the Pt layer 244 of the lower electrode 24, the piezoelectric layer 26 consisting of the PZT layer 260 and the upper electrode consisting of the Titanium-Tungsten film 280.

Table 2 shows layer thicknesses of two examples of the second embodiment.

TABLE 2

| Layer | Layer thickness (nm) Example 1 | Layer thickness (nm) Example 2 |
|---|---|---|
| TiW | 85 | 100 |
| PZT | 1000 | 2000 |
| Pt | 100 | 100 |
| Ti | 30 | 30 |
| Si3N4 | 1000 | 1000 |

For example, the substrate 30 has a thickness of 1000 nanometer. The adhesion layer 242 has a thickness of 30 nanometer, and the Pt layer 244 has a thickness of 100 nanometer. In the first example, a TiW layer thickness of 85 nanometer is sufficient for a PZT layer of 1000 nanometer. In the second example, a TiW layer thickness of 100 nanometer is sufficient for a PCT layer thickness of 2000 nanometer. Thus, the upper electrode has a thickness less than a tenth of the thickness of the piezoelectric layer 26.

Figure 4:
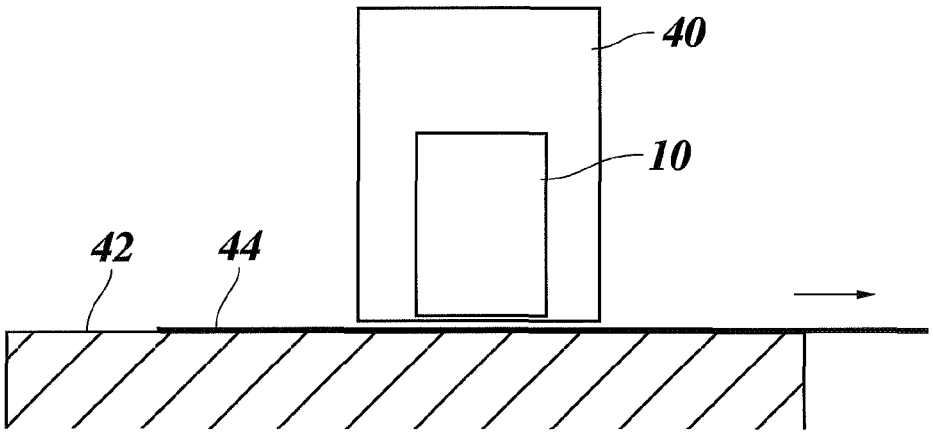
FIG. 4 is a schematic partial view of a printing apparatus.

FIG. 4 schematically shows a print head carriage 40 of printing machine, which is mounted to reciprocate above a printing medium support surface 42. The carriage 40 is equipped with at least one print head 10 for printing on a printing medium 44 that is conveyed through a gap between the support surface 42 and the carriage 40.

Figure 5A:
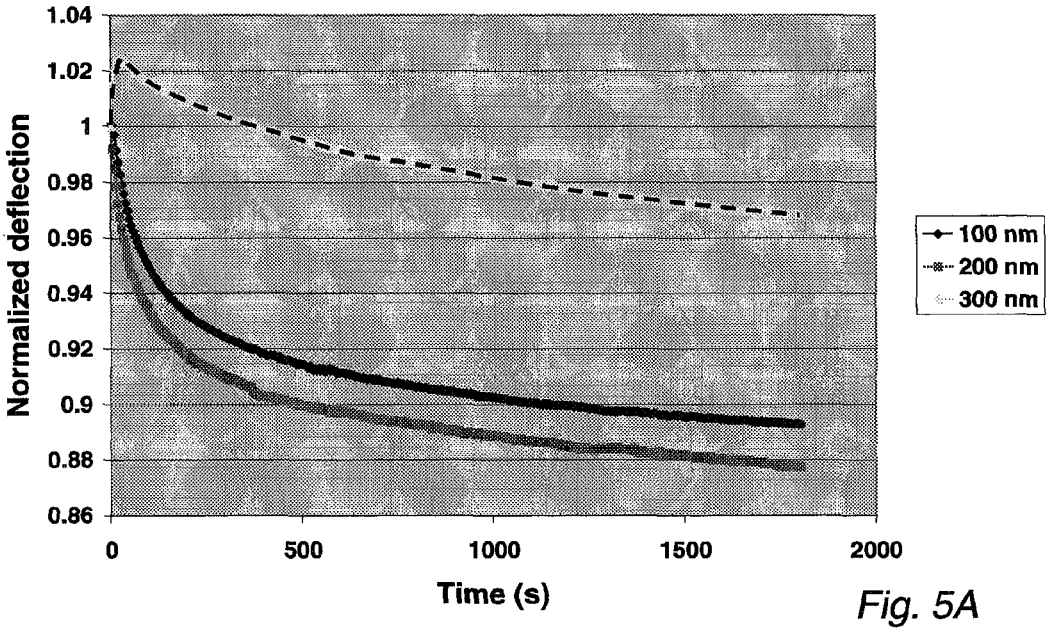
FIGS. 5A and 5B each show a graph of the normalized deflection of the piëzo electric actuator as used in the print head according to the present invention in dependence of time.
Figure 5B:
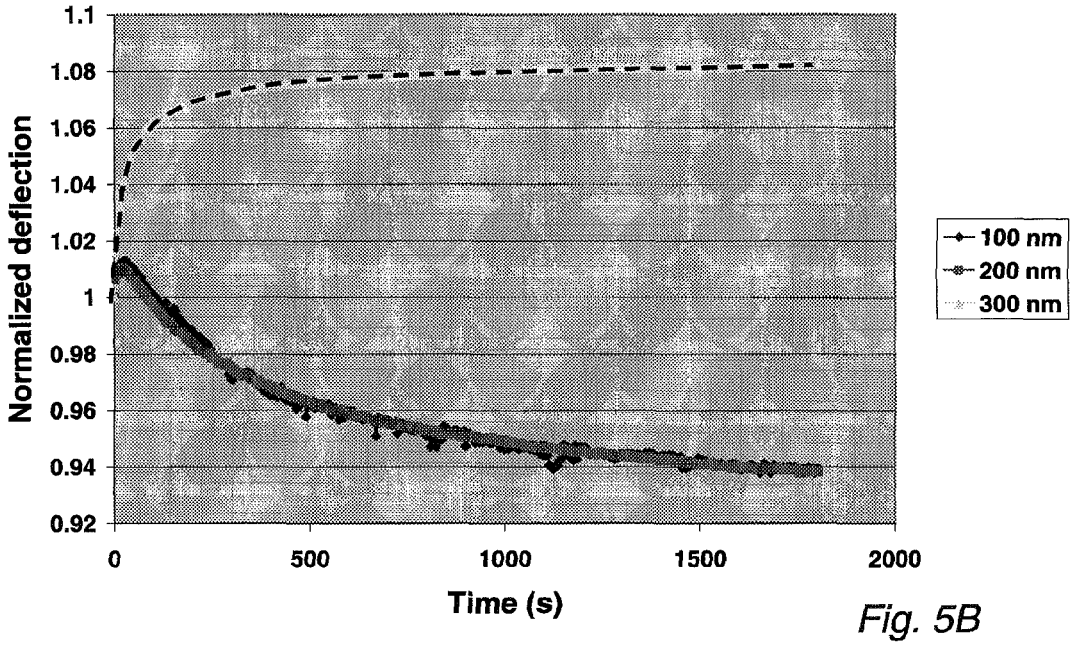

FIG. 5A and 5B each show a graph with time on the horizontal axis and deflection of a piezo-actuator as used in a print head according to the present invention. The deflection is normalized to the deflection as occurring directly after manufacturing. Each graph shows three lines: one for a TiW layer having a thickness of 100 nm, one for a TiW layer thickness of 200 nm and one for a TiW layer thickness of 300 nm (dashed line). FIG. 5A presents results obtained with an actuation pulse between −30V dc and +30V ac. FIG. 5B presents results obtained with an actuation pulse between −10V dc+10V ac. As is apparent from the graphs, with a stress compensating layer of TiW having a thickness of 300 nm, the deflection does not deteriorate as quick as for the less compensating layers of 100 nm and 200 nm. Moreover, with a limited actuation pulse (FIG. 5B) the deflection even increases over time. This is a clear indication that the durability and/or stability of the piëzo actuator improves due to the stress compensation.

The invention claimed is:

1. Ink jet print head, including:

a pressure generation chamber for being in communication with a print head nozzle; and an actuator membrane for delimiting the pressure generation chamber, the actuator membrane comprising a multilayer package comprising a substrate and a piezoelectric actuator provided on the substrate, said piezoelectric actuator comprising a lower electrode, an upper electrode and at least one piezoelectric layer arranged between the lower electrode and the upper electrode, wherein the substrate and the upper electrode are arranged on opposite sides of the piezoelectric layer, wherein the upper electrode comprises a Titanium-Tungsten film, and wherein the thickness of the Titanium-Tungsten film is chosen such that thicknesses of the layers of the resulting substantially flat multilayer package fulfill the equation $$\Sigma\sigma_i t_i(z_i-z_0)=0,$$

the sum being taken for all layers i=1, . . . , n, and in which $\sigma$=stress in layer i, $t_i$=thickness of layer i, and $(z_i-z_0)$=distance between the center of layer i and a neutral plane of the multilayer package, wherein the neutral plane is the plane in which the bending tension is zero when the package is being bent.

2. Ink jet print head according to claim 1, wherein the piezoelectric layer is a piezoelectric ceramic layer.

3. Ink jet print head according to claim 1, wherein the piezoelectric layer is a piezoelectric lead zirconate titanate layer.

4. Ink jet print head according to claim 1, wherein the piezoelectric actuator is arranged for deflecting the actuator membrane by deflecting the piezoelectric layer when energized, and wherein a topmost layer to be deflected with the piezoelectric layer is a conductive layer of the upper electrode.

5. Ink jet print head according to claim 1, wherein the upper electrode consists of the Titanium-Tungsten film.

6. Ink jet print head according to claim 1, wherein the Titanium-Tungsten film comprises a compressive stress.

7. Ink jet print head according to claim 1, wherein the Titanium-Tungsten film comprises a compressive stress, thereby increasing a flatness of said substrate and said piezoelectric actuator.

8. Ink jet print head according to claim 1, wherein the upper electrode has a thickness less than a tenth of a thickness of the at least one piezoelectric layer.

9. Ink jet print head according to claim 1, wherein the upper electrode has a thickness less than 500 nm.

10. Inkjet print head according to claim 1, wherein the piezoelectric actuator is covered with a moisture barrier layer, the moisture barrier layer for example comprising $Al_2O_3$ or comprising a layered structure of $SiO_2/Si_3N_4/SiO_2$.

11. Printing apparatus, including at least one ink jet print head according to claim 1.

12. Ink jet print head, including:

a pressure generation chamber for being in communication with a print head nozzle; and an actuator membrane for delimiting the pressure generation chamber, the actuator membrane comprising a multilayer package comprising a substrate and a piezoelectric actuator provided on the substrate, said piezoelectric actuator comprising a lower electrode, an upper electrode and at least one piezoelectric layer arranged between the lower electrode and the upper electrode, wherein the substrate and the upper electrode are arranged on opposite sides of the piezoelectric layer, wherein the upper electrode comprises a Titanium-Tungsten film, wherein the thickness of the Titanium-Tungsten film is chosen such that thicknesses of the layers of the resulting substantially flat multilayer package fulfill the equation $$\Sigma\sigma_i t_i(z_i-z_0)=0,$$

the sum being taken for all layers i=1, . . . , n, and in which $\sigma_i$=stress in layer i, $t_i$=thickness of layer i, and $(z_i-z_0)$=distance between the center of layer i and a neutral plane of the multilayer package, wherein the neutral plane is the plane in which the bending tension is zero when the package is being bent, wherein the piezoelectric layer is a piezoelectric lead zirconate titanate layer, wherein the piezoelectric actuator is arranged for deflecting the actuator membrane by deflecting the piezoelectric layer-when energized, wherein a topmost layer to be deflected with the piezoelectric layer is a conductive layer of the upper electrode, wherein the upper electrode consists of the Titanium-Tungsten film, wherein the Titanium-Tungsten film comprises a compressive stress, thereby increasing a flatness of said substrate and said piezoelectric actuator, wherein the upper electrode has a thickness less than a tenth of a thickness of the at least one piezoelectric layer, wherein the upper electrode has a thickness less than 500 nm, and wherein the piezoelectric actuator is covered with a moisture barrier layer, the moisture barrier layer for example comprising $Al_2O_3$ or comprising a layered structure of $SiO_2/Si_3N_4/SiO_2$.

* * * * *